US008368610B2

(12) United States Patent
Kviatkofsky et al.

(10) Patent No.: US 8,368,610 B2
(45) Date of Patent: Feb. 5, 2013

(54) SHAPED BALLISTIC RADOME

(75) Inventors: James F. Kviatkofsky, Allen, TX (US); Gary F. Wahlquist, McKinney, TX (US); Jerry M. Grimm, Plano, TX (US); David R. Bishop, Nevada, TX (US); Kuang-Yuh Wu, Plano, TX (US)

(73) Assignee: Raytheon Company, Waltham, MA (US)

( * ) Notice: Subject to any disclaimer, the term of this patent is extended or adjusted under 35 U.S.C. 154(b) by 1206 days.

(21) Appl. No.: 11/863,450

(22) Filed: Sep. 28, 2007

(65) Prior Publication Data

US 2012/0176294 A1 Jul. 12, 2012

(51) Int. Cl.
*H01Q 1/42* (2006.01)

(52) U.S. Cl. ..... 343/872

(58) Field of Classification Search ..... 343/872
See application file for complete search history.

(56) References Cited

U.S. PATENT DOCUMENTS

| | | | | |
|---|---|---|---|---|
| 3,780,374 | A * | 12/1973 | Shibano et al. | 343/872 |
| 4,666,873 | A | 5/1987 | Morris, Jr. et al. | |
| 5,140,338 | A | 8/1992 | Schmier et al. | |
| 5,182,155 | A | 1/1993 | Roe | |
| 6,091,375 | A * | 7/2000 | Goto et al. | 343/872 |
| 6,218,995 | B1 * | 4/2001 | Higgins et al. | 343/719 |
| 7,057,567 | B2 | 6/2006 | Koch | |
| 7,420,523 | B1 * | 9/2008 | Ziolkowski et al. | 343/872 |
| 2003/0150321 | A1 | 8/2003 | Lucuta et al. | |

FOREIGN PATENT DOCUMENTS

| | | | |
|---|---|---|---|
| DE | 19724320 | A1 | 12/1998 |
| EP | 1796210 | A1 | 6/2007 |
| JP | 10122799 | A | 5/1998 |
| JP | 2004200895 | A | 7/2004 |
| JP | 2005167692 | A | 6/2005 |
| WO | WO 2006/011133 | A1 | 2/2006 |

OTHER PUBLICATIONS

Japanese Office Action dated Dec. 20, 2011 No. 2009-530622; 7 pages.
Chinese Office Action dated Dec. 19, 2011 No. 200780036075.3; 1 page.
Chinese Office Action dated Jun. 20, 2012 for corresponding Application No. 200780036075.3; 7 pages.
Japanese Office Action dated Jul. 24, 2012 for corresponding Japanese Application No. 2009-530622 (5 pages).

* cited by examiner

*Primary Examiner* — Dieu H Duong
(74) *Attorney, Agent, or Firm* — Cantor Colburn LLP

(57) ABSTRACT

Methods and devices for shaped ballistic radomes according to various aspects of the present invention comprise systems for shielding transmission devices; and more particularly, representative and exemplary embodiments of the present invention generally relate to improved methods and systems for ballistic deflection and protection of antenna equipment units, and/or the like.

19 Claims, 8 Drawing Sheets

SHAPED BALLISTIC RADOME

RELATED APPLICATIONS

This application claims the benefit of U.S. Provisional Patent Application Ser. No. 60/827,481 filed in the United States Patent and Trademark Office on Sep. 29, 2006. This application additionally relies in part on the disclosure of U.S. patent application Ser. No. 11/297,999 for enabling support.

BACKGROUND OF INVENTION

Radomes are used to protect an antenna. This protection may be from the weather, such as ice, snow, sand, wind, or rain, or it may be from observers attempting to deduce the orientation of the covered antenna. Radomes may be distinguished from other structures in that the material used in building the radome generally allows for a relatively unattenuated electromagnetic signal between the antenna inside the radome and outside equipment. However, this typically thin-walled approach is in direct contrast to the heavy-thickness armoring techniques employed to achieve protection against projectile strikes and other airborne foreign bodies.

Prior attempts to address this problem take up large amounts of surface area, add excessive weight, and the space between the interior of the radome and antenna equipment is severely limited. Also, the structures, while offering some basic ballistic protection were not designed to minimize penetration. Accordingly, there exists a need to address these and other deficiencies associated with conventional techniques.

SUMMARY OF THE INVENTION

Methods and devices for shaped ballistic radomes according to various aspects of the present invention comprise systems for shielding transmission devices; and more particularly, representative and exemplary embodiments of the present invention generally relate to improved methods and systems for ballistic deflection and protection of antenna equipment units and/or the like.

BRIEF DESCRIPTION OF THE DRAWINGS

Representative elements, operational features, applications and/or advantages of the present invention reside inter alia in the details of construction and operation as more fully hereafter depicted, described or otherwise identified—reference being made to the accompanying drawings, images, figures, etc. forming a part hereof—wherein like numerals refer to like parts throughout. Other elements, operational features, applications and/or advantages will become apparent in view of certain exemplary embodiments recited in the claims.

Elements in the figures, drawings, images, etc. are illustrated for simplicity and clarity and have not necessarily been drawn to scale. For example, the dimensions of some of the elements in the figures may be exaggerated relative to other elements to help improve understanding of various embodiments of the present invention. Furthermore, the terms 'first', 'second', and the like herein, if any, are used inter alia for distinguishing between similar elements and not necessarily for describing a sequential or chronological order. Moreover, the terms 'front', 'back', 'top', 'bottom', 'over', 'under', and the like in the disclosure and/or in the claims, are generally employed for descriptive purposes and not necessarily for comprehensively describing exclusive relative position. It will be understood that any of the preceding terms so used may be interchanged under appropriate circumstances such that various embodiments of the invention described herein, for example, are capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventors' conception of the best mode, and are not intended to limit the applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

The present invention may be described herein in terms of transmission protection and/or shielding materials, mounting devices, and transmission devices. It should be appreciated that such transmission protection and/or shielding materials may comprise any number of conventional materials including, but not limited to, ceramics, metals, plastics, fiberglass, glass, various other inorganic and organic materials, and/or the like. Furthermore, such transmission protection and/or shielding materials may comprise various forms, layers, sizes, textures and dimensions.

The particular implementations shown and described herein are illustrative of the invention and its best mode and are not intended to otherwise limit the scope of the invention in any way. Indeed, for the sake of brevity, various conventional transmission devices, structural components of various shielding and/or protection devices, and the like, may not be described in detail herein. Additionally, the present invention may be practiced in conjunction with any number of devices, and the systems described are merely exemplary applications. Further, the present invention may employ any number of conventional techniques for ballistic protection and the like.

Figure 1:
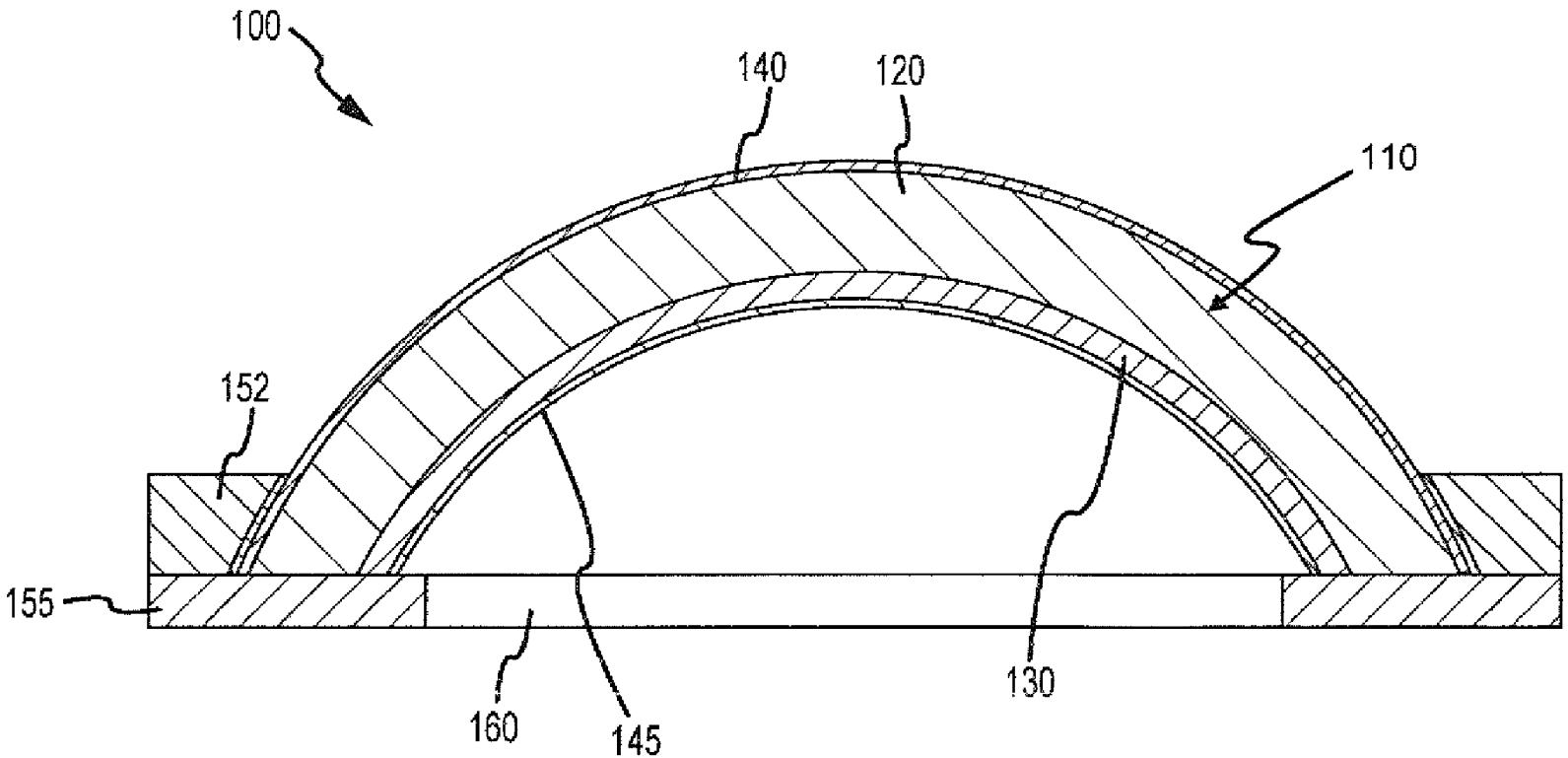
FIG. 1 illustrates a cut-away view of a shaped ballistic radome in accordance with a representative embodiment of the present invention.

Referring to FIG. 1, a system for providing a shaped ballistic radome 100, according to various aspects of the present invention, may be implemented in conjunction with a radome 110. The radome 110 may comprise a shaped material 120. Also, the shaped ballistic radome 100 may be implemented in conjunction with matching sheets 140 and 145, and attachment mechanism for attaching to a secondary surface.

Figure 2A:
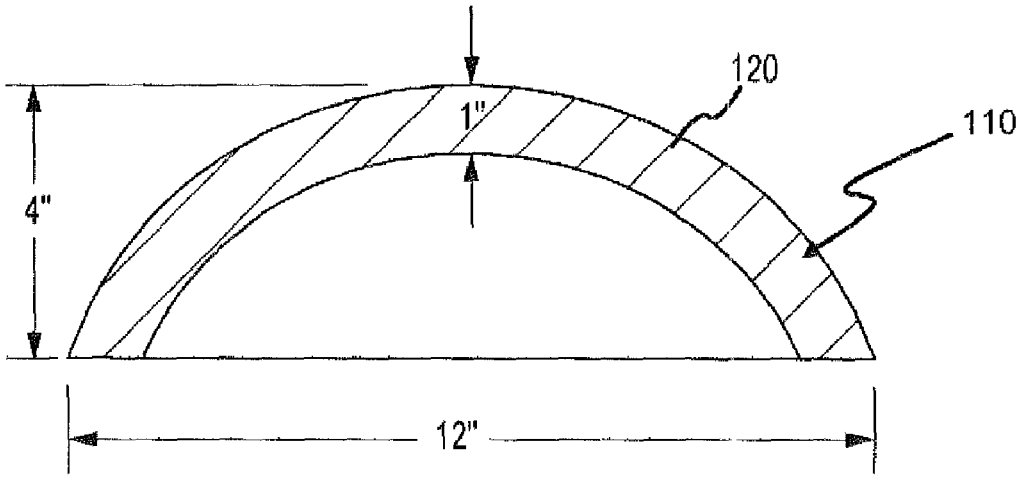
FIG. 2A illustrates a cross-sectional view of a radome in accordance with another representative embodiment of the present invention.
Figure 2B:
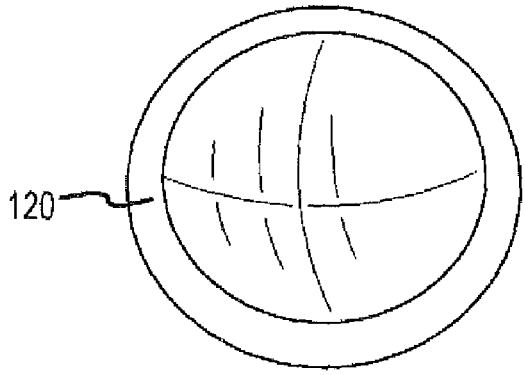
FIG. 2B illustrates a view of a top portion of a radome in accordance with another representative embodiment of the present invention.
Figure 2C:
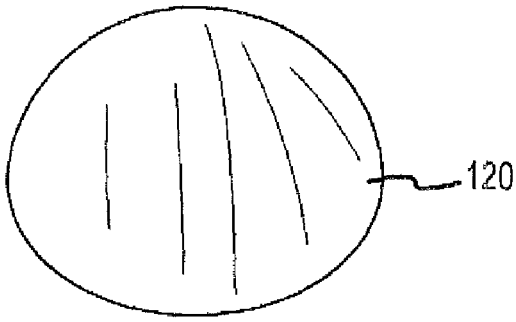
FIG. 2C illustrates a view of a top portion of a radome in accordance with another representative embodiment of the present invention.

Referring to FIGS. 2A, 2B, and 2C, the radome 110 may comprise any covering. This covering may be used in conjunction with antenna equipment. The radome 110 generally provides protection against, including but not limited to, weather, debris, projectiles, contamination, corrosion, external surveillance, and/or the like. Radome 110 may be configured to conceal and protect antenna equipment and designed to minimize interference with, or degradation of, transmitting or receive receiving capabilities. In the present embodiment, radome 110 may comprise at least one of a shaped material 120 and/or a spall layer 130. The radome 110 may be coupled to a plurality of matching sheets 140, 145.

Figure 3:
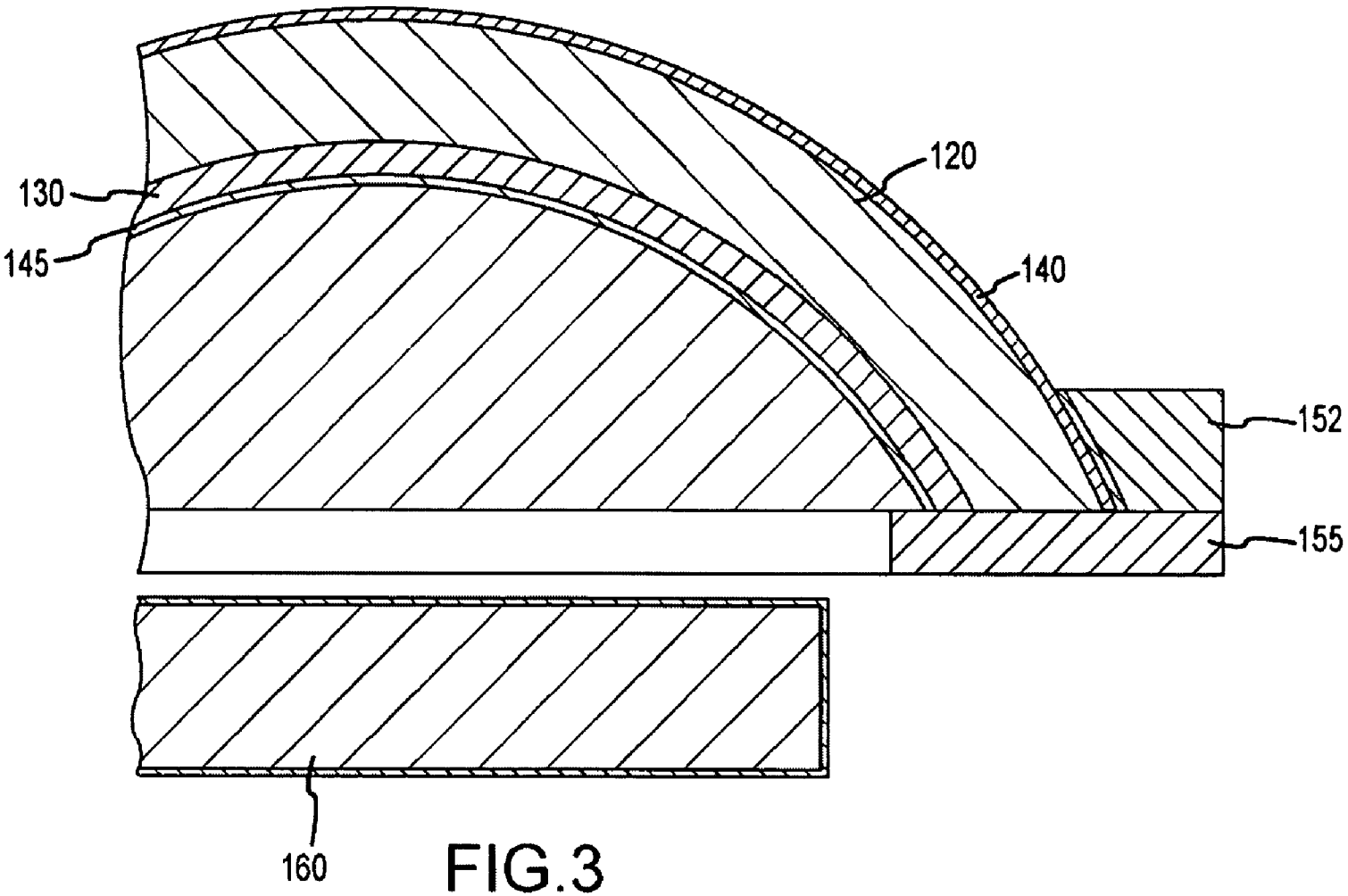
FIG. 3 illustrates a cut-away view of a shaped ballistic radome in accordance with yet another representative embodiment of the invention.

The shaped material 120 and/or protection materials, as shaped, may form a curvature to reduce ballistic damage, deflect material, protect against debris, weather, and/or the like. In an alternative representative embodiment, the shaped material 120 may be formed to streamline the ballistic shaped radome 100, thereby reducing drag or to camouflage the system. The shaped material 120 may be constructed from any suitable material. For example, shaped material 120 may be suitably robust to protect against a projectile strike and may be formed into any suitable geometry. In a representative embodiment, referring now to FIG. 3, shaped material 120 may increase the area that comprises a high degree of obliquity, axial inclination and/or the like, to at least one of decrease ballistic damage and/or deflect projectiles and debris. Similarly, shaped material 120 and/or shielding materials, in accordance with the present invention, may be implemented to form various shapes, or at least partial shapes, including but not limited to domes, spheres, ovoids, prolate, and/or oblate spheroids, and/or the like. Furthermore, shaped material 120 and/or shielding materials may be at least partially segmented into various geometric planes and/or faces, such as, for example hexagonal, pentagonal, octagonal, and/or the like. The shaped material 120 may comprise one material or many layered materials.

In a representative embodiment, shaped material 120 may comprise any suitable width. In an exemplary embodiment, shaped material 120 may comprise an approximately 1 inch ceramic layer. In another embodiment, shaped material 120 may comprise at least a portion of an arc geometry.

The shaped ballistic radome 100 may comprise a spall liner 130. Spall liner 130 generally operates to reduce the number of potential fragments and narrows a debris fragment cone. Spall liner 130 may also provide noise and thermal insulation. For example, spall liner 130 may be adapted to provide protection against multiple-strike, kinetic energy rounds, shaped charges, and/or the like. Additionally, spall liner 130 may provide additional support for shaped ballistic radome 100 structures. The spall liner 130 may be fabricated from one material, or it may comprise multiple layers and/or materials.

In a representative embodiment, the spall liner 130 may be coupled to the internal surface of the shaped material 120 nearest to the antenna equipment unit 160. The spall liner 130 may be substantially the same shape as the internal surface of the shaped material 120. Though it may be fabricated out of any suitable material or combination of materials, spall layer 130 may comprise a CE/glass material.

The shaped ballistic radome 100 may also comprise a plurality of matching sheets 140, 145 for impedance matching. An impedance match tunes out the capacitive reactance of the joint dielectric framework by adding a properly designed inductive circuit to a dielectric framework. With an impedance match, the framework no longer scatters energy. In effect, the framework disappears, reducing transmission loss and thereby removing the scattered energy degradation from the antenna. Matching sheets 140, 145 may generally comprise the exterior and interior surfaces of the shaped ballistic radome 100. Alternatively, conjunctively, or sequentially, matching sheets may be incorporated around the interior and exterior of any individual component layer of material. For example, spall layer 130 may be sandwiched between a plurality of matching sheets coupled to the shaped material 120 and sandwiched between two additional matching sheets.

The matching sheets 140, 145 may be fabricated from any suitable materials. Additionally, matching sheets 140, 145 may be shaped into any suitable shape. Generally, matching sheets 140 and 145 will substantially approximate the shape of the surface for which it may be intended to be coupled.

The matching sheets 140, 145 may be suitably configured to perform impedance matching to tune out framework loss as needed by the electrical performance requirements of the transmission equipment.

In a representative embodiment, matching sheet 140 may be fabricated to approximate the external shape of shaped material 120. Though they may be fabricated out of any suitable material or combination of materials, in a representative embodiment, matching sheets 140 and 145 may be manufactured from high-density polyethylene. In another representative embodiment, matching sheet 145 may be fabricated to approximate the internal shape of shaped material 120. Additionally, matching sheet 140 may be coupled to the shaped material 120 using an adhesive. Similarly, matching sheet 145 may be coupled to the spall layer 130 using an adhesive. While first matching sheet 140 and second matching sheet 145 may be any suitable thickness, in a representative and exemplary embodiment, each sheet may be approximately one sixteenth of an inch thick.

It will be appreciated that the attachment mechanism of the present invention may comprise any conventional attachment means, such as, for example: rings, mounting devices, frames, plates, bases, screws, nuts, bolts, nails, adhesives, welds, couplers, and/or the like. Moreover, the attachment mechanism of the present invention may comprise any conventional materials, such as, for example: ceramics, metals, plastics, fiberglass, glass, various other inorganic and organic materials, and/or the like. The specifications for attachment mechanism (e.g., size, shape, form, texture, dimensions, integrity, and/or the like), may comprise any parameters that are substantially suited for implementation with various embodiments of the present invention. Attachment mechanism may be designed such that its implementation minimizes the contribution to degrading transmission of electrical signals.

It will further be appreciated that the attachment mechanism may be attached to, affixed to, and/or connected to the radome 110 and/or shielding materials to substantially form the radome and shielding devices. In an exemplary implementation, the attachment mechanism may comprise a ring frame top plate 152 and ring frame bottom plate 155. In another embodiment, the attachment mechanism for the shaped ballistic radome 100 generally allows for repeatable access to the antenna equipment unit 160 components. For instance, the attachment mechanism may be suitably designed to remove at least a portion of the shaped ballistic radome 100 to provide access to antenna equipment unit 160 components. In an alternative embodiment, antenna equipment unit 160 components may be positioned below the secondary surface, and the shaped ballistic radome 100 may be mounted substantially flush with surrounding secondary surfaces.

Figure 6A:
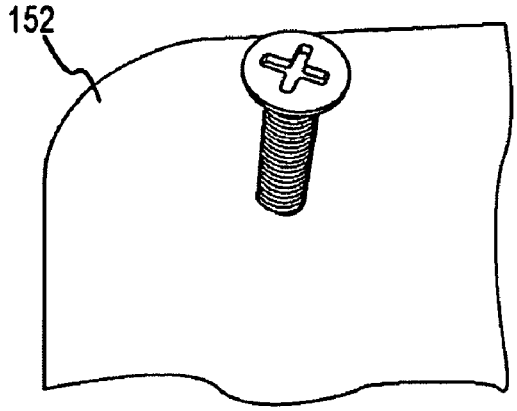
FIG. 6A depicts a representative view of a mounting device in accordance with an exemplary embodiment of the present invention.
Figure 6B:
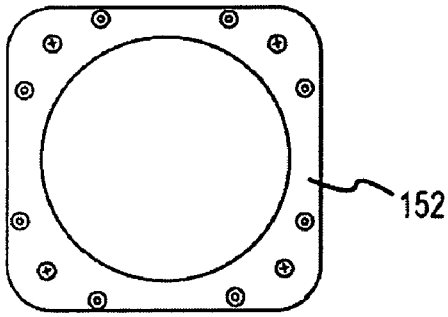
FIG. 6B illustrates a top view of a radome assembly in accordance with representative embodiment of the present inventions.
Figure 6C:
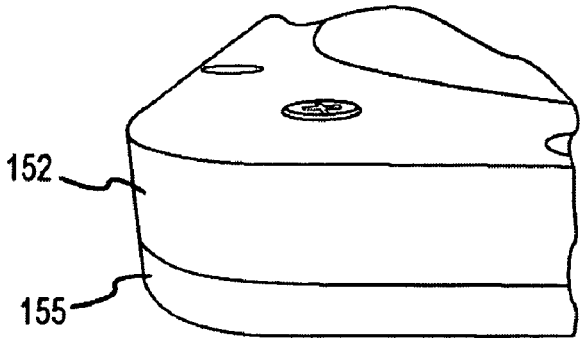
FIG. 6C illustrates an enlarged view of a corner section of an assembled radome.

Referring to FIGS. 6A, 6B, and 6C, in a representative embodiment, the attachment mechanism may comprise a ring frame top plate 152 and ring frame base plate 155. Ring frame top plate 152 generally secures the radome 110 to the ring frame base plate 155. The ring frame top plate 152 may be any suitable shape or dimension and may be constructed out of any suitable material. The ring frame top plate 152 may use any means to connect to a secondary surface or ring frame base plate 155, whether now known or otherwise hereafter described in the art. In one embodiment, though other securing methods may be employed, ring frame top plate 152 may be attached to a secondary surface using screws.

In a representative embodiment, ring frame top plate 152 may be configured to couple to ring frame base plate 155. In another representative embodiment, the radome 110 exterior circumferential perimeter base may be substantially encompassed by the ring frame top plate 152. In another embodiment, the ring frame top plate 152 may be coupled to the radome 110 and/or matching layer 140 by a pressure fit of the sloped edge of the ring frame top plate 152 and the circumferential edge of the radome 110. The width of the edge of the radome 110 generally prevents or otherwise impedes it from being dislocated from the ring frame top plate 152. In a representative and exemplary embodiment, the ring frame top plate 152 may be fabricated from aluminum. In another representative embodiment, the ring frame top plate 152 may be attached to the ring frame base plate 155 via a plurality of ⅜ inch threaded screws.

Ring frame base plate 155 generally comprises a coupling surface for the radome 110, matching sheets 140, 145, and/or spall layer 130. Ring frame base plate 155 may be fabricated such that its screw holes suitably match those of ring frame top plate 152. Ring frame base plate 155 may be anchored to a secondary surface through any suitable means, fabricated from any suitable material, and comprise any suitable thickness or shape. By combining ring frame top plate 152 with ring frame base plate 155, a pressure fit containment of the shaped ballistic radome 100 elements may be achieved. In one embodiment of the present invention, referring to FIG. 6C, the ring frame base plate 155 may comprise an internal opening through which the AEU 160 components may pass. Though it may be manufactured from any suitable material, in a representative embodiment, the ring frame base plate 155 may comprise aluminum.

Figure 4A:
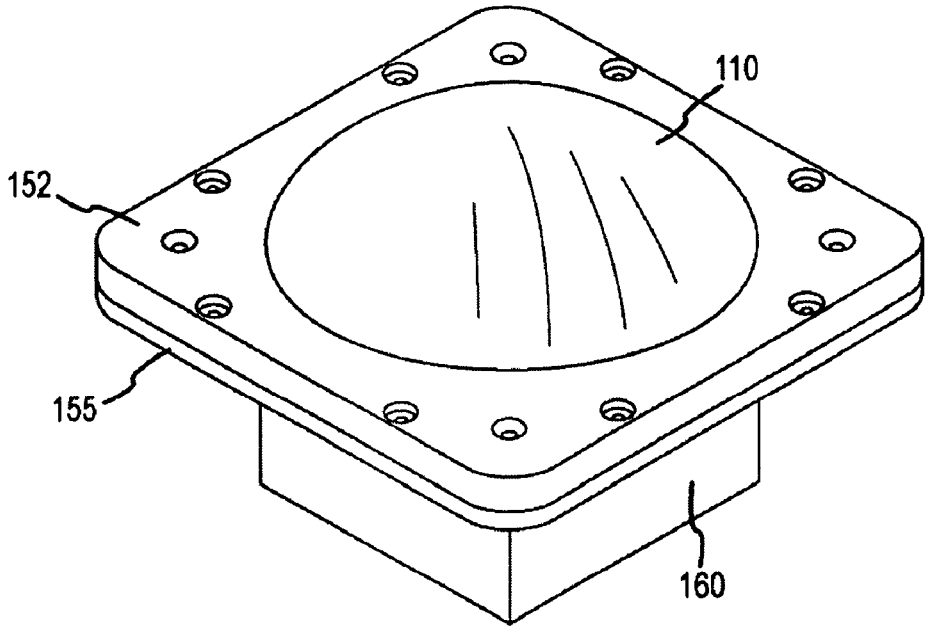
FIG. 4A illustrates a view of a radome assembly in accordance with another representative embodiment of the present invention.
Figure 4B:
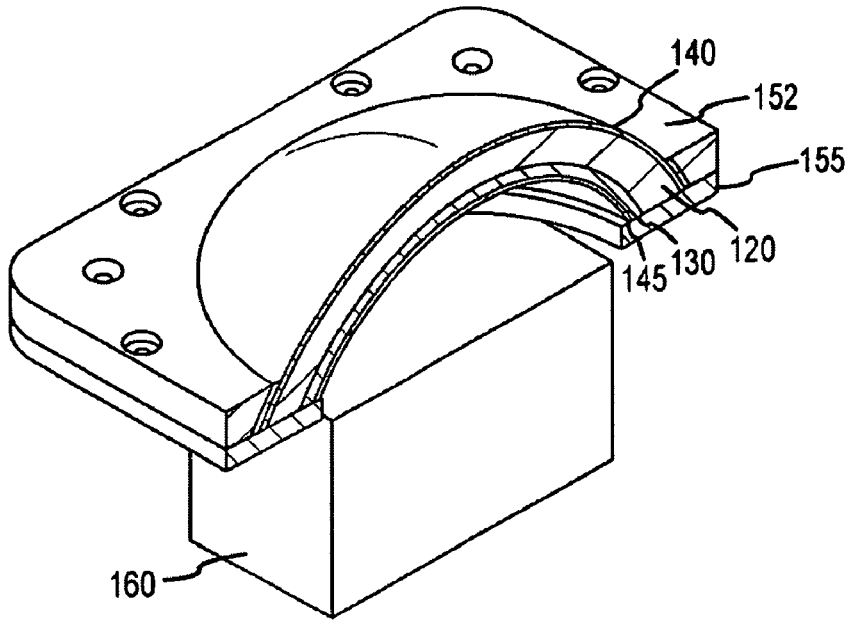
FIG. 4B illustrates a cross-sectional view of the radome assembly.

The antenna equipment unit 160 (AEU) may comprise any device used in conjunction with transmitting electronic signals. This may include an antenna, scanned array sensors, switches, phase shifters, power sources, electronic packages, RF components, radiating devices, modulators, receivers, transmitters, transceivers controllers, sensors, and/or the like. The AEU may be of any suitable orientation and any suitable shape. The AEU 160 may be substantially contained within the radome 110 or alternatively, only a portion of the AEU 160 may be contained within the radome 110. Referring to FIGS. 4A and 4B, the AEU 160 may be located substantially beneath the ring frame base plate 155, or portions of the AEU 160 may be located above the ring frame base plate 155 opening. In accordance with representative aspects of the present invention, such transmission devices may comprise conventional transmission devices for transmitting RADAR, SONAR, LIDAR, and/or the like. These transmission devices may transmit in any suitable frequency band.

Figure 7:
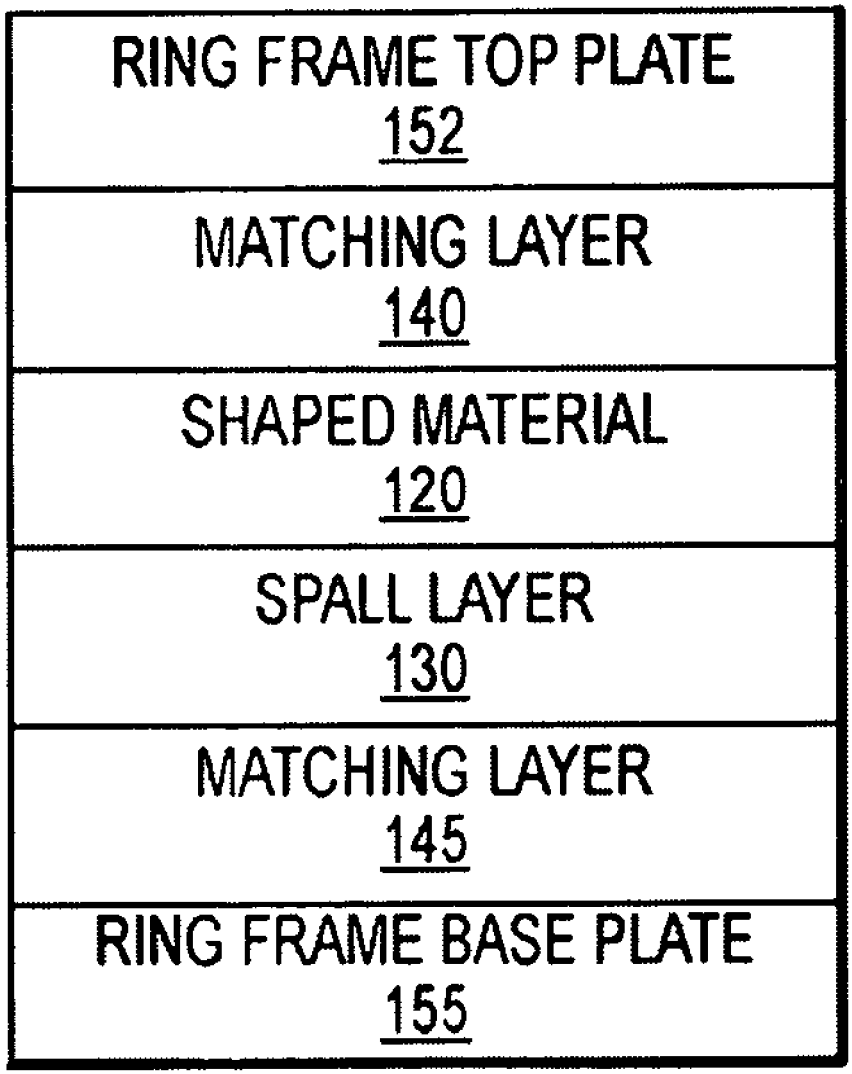
FIG. 7 is a block diagram illustrating a layered construction of a representative shaped ballistic radome.

Referring to FIG. 7, the shaped ballistic radome 100 generally provides protection for electronics equipment. In a representative embodiment, the electronics equipment may comprise an antenna equipment unit 160. The shaped ballistic radome 100 may be fabricated with matching sheet 140 coupled to the exterior surface of the shaped material 120 of the radome 110. This shaped surface may be designed to present an oblique angle to a striking projectile. Spall layer 130 may be coupled to the shaped material 120. Spall layer 130 generally provides additional support for the shaped ballistic radome 100 elements. Matching sheet 145 may be coupled to the interior surface of the spall layer 130. In a representative embodiment, these elements may be secured to a second surface by a top and base ring frame plate 152, 155. The shaped ballistic radome 100 elements generally provide an electrically transparent, protective shield for the AEU 160 components.

Figure 5A:
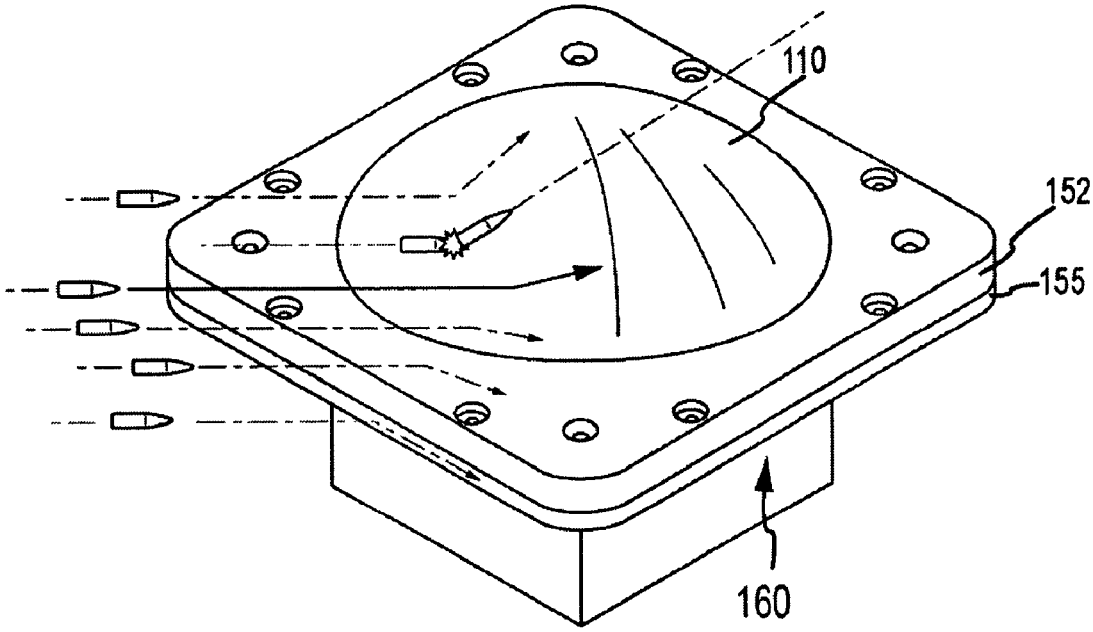
FIG. 5A illustrates a view of projectile deflection in accordance with a representative radome embodiment.
Figure 5B:
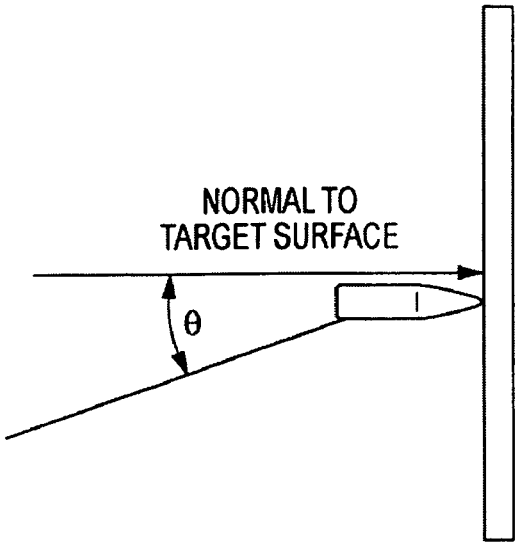
FIG. 5B illustrates how the deflection angle is determined in accordance with a representative radome embodiment.
Figure 5C:
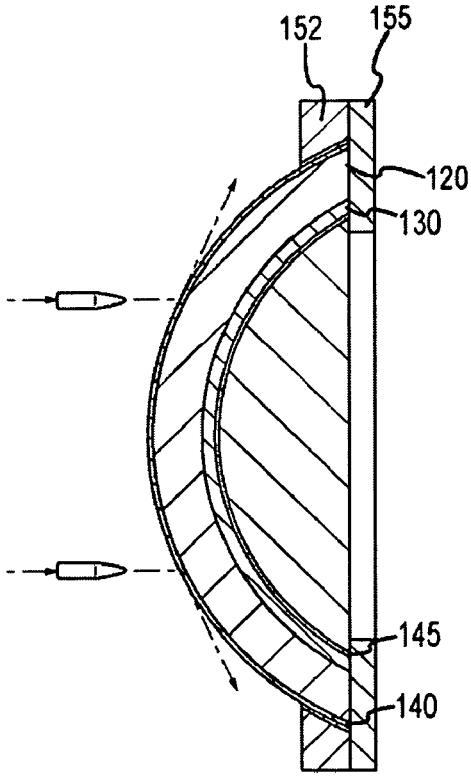
FIG. 5C illustrates a cross-sectional view of a radome assembly and a deflected projectile.

AEU 160 components may be housed under the shaped ballistic radome 100. The shaped ballistic radome 100 elements may be configured to present minimal transmission loss while providing protection from external factors. In addition to other functions, referring to FIGS. 5A, 5B, and 5C, the shaped ballistic radome's 100 configuration generally affords increased protection from projectiles by being designed to alter their trajectory and/or deflect their impact. Also, its configuration generally provides increased area for electronics equipment and AEU 160 components to be housed. For example, there may be increased deflection space between the interior surface of the shaped ballistic radome 100 and the AEU 160 components as compared to a flat radome apparatus. Adequate space may be available for deformation of the shaped ballistic radome 100 towards the AEU 160 resulting from a projectile strike. Additionally, in the present embodiment, the arched shape generally provides enhanced structural strength against center projectile impacts.

In the foregoing specification, the invention has been described with reference to specific exemplary embodiments; however, it will be appreciated that various modifications and changes may be made without departing from the scope of the present invention as set forth herein. The specification is to be regarded in an illustrative manner, rather than a restrictive one, and all such modifications are intended to be included within the scope of the present invention. Accordingly, the scope of the invention should be determined by the claims and their legal equivalents rather than by merely the examples described above.

For example, the steps recited in any method or process embodiment may be executed in any order, and are not limited to, the specific order presented in the claims. Additionally, the components and/or elements recited in any apparatus or composition embodiment may be assembled, or otherwise operationally configured, in a variety of permutations to produce substantially the same result as the present invention, and are accordingly not limited to the specific configuration recited in claims.

Benefits, other advantages and solutions to problems have been described above with regard to particular embodiments; however, any benefit, advantage, solution to problem, or any element that may cause any particular benefit, advantage or solution to occur, or to become more pronounced, are not to be construed as critical, required or essential features or components of the invention.

As used herein, the terms "comprising", "having", "including" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

We claim:

1. A shaped ballistic radome for protection an antenna equipment unit comprising:

a shaped radome material for shielding the antenna equipment unit, wherein said shaped radome material forms a curved surface configured to reduce an area corresponding to a relative low degree of obliquity for impacting projectiles away from the antenna equipment unit;

a spall liner conforming to and coupled to an inner-most surface of the shaped radome material between the antenna equipment unit and the shaped radome material; and an attachment mechanism configured to couple the shaped ballistic radome to a base plate, the attachment mechanism including a top plate that is affixable to the base plate such that a sloped edge thereof pressure fits against an edge of the shaped ballistic radome.

2. The shaped ballistic radome of claim 1, wherein the shape of said shaped radome material comprises at least a portion of an arc.

3. The shaped ballistic radome of claim 1, wherein the shape of said shaped radome material is configured to provide structural strength against center projectile impacts.

4. The shaped ballistic radome of claim 1, where the shape of said shaped radome material is configured to provide increased space between an inner surface of the spall liner and a top of said antenna equipment unit.

5. The shaped ballistic radome of claim 1, wherein shape of said shaped radome material is configured to provide increased space for locating said antenna equipment unit.

6. The shaped ballistic radome of claim 1, further comprising a mechanism for attaching said shaped ballistic radome to a secondary surface.

7. The shaped ballistic radome of claim 1, further comprising a pair of matching sheets for providing an impedance match to a dielectric framework formed by the shaped radome material and the spall liner, wherein a first sheet from the pair of matching sheets is coupled to an inner surface of the spall liner between the antenna equipment unit and the spall liner and a second sheet from the pair of matching sheets is coupled to an outer surface of said shaped radome material.

8. The shaped ballistic radome of claim 1, wherein the shape of said shaped radome material is substantially concave.

9. A shaped ballistic radome comprising:

an antenna equipment unit;

a shaped top radome surface for shielding said antenna equipment unit, wherein the shaped top radome surface forms a curved surface configured to reduce an area that comprises a low degree of obliquity for incoming projectiles to deflect the incoming projectiles away from the antenna equipment unit, a curvature of the curved surface extending to an outer edge of the shaped top radome surface;

a spall liner conforming to and coupled to an inner surface of said shaped top radome surface, wherein the spall liner is disposed between the antenna equipment unit and the shaped top radome surface;

a plurality of matching sheets for providing an impedance match to a dielectric framework formed by the shaped top radome surface and the spall liner, wherein a first sheet from the plurality of matching sheets is coupled to an inner surface of the spall liner between the antenna equipment unit and the spall liner and a second sheet from the plurality of matching sheets is coupled to an outer surface of the shaped top radome surface; and an attachment mechanism configured to couple the shaped ballistic radome to a base plate, the attachment mechanism including a top plate including a sloped edge having a curvature that is complementary to the curvature of the curved surface at the outer edge of the shaped top radome surface, the top plate being affixable to the base plate such that the sloped edge thereof pressure fits against the complementarily curved outer edge of the shaped ballistic top radome surface.

10. The shaped ballistic radome of claim 9, wherein the shape of said shaped top radome surface comprises at least a portion of an arc.

11. The shaped ballistic radome of claim 9, wherein the shape of said shaped top radome surface is configured to provide structural strength against center projectile impacts.

12. The shaped ballistic radome of claim 9, wherein the shape of said shaped top radome surface is configured to provide increased space between the interior surface of said shaped top radome surface and the top of said antenna equipment unit.

13. The shaped ballistic radome of claim 9, wherein the shape of said shaped top radome surface is configured to provide increased space for locating said antenna equipment unit.

14. The shaped ballistic radome of claim 9, wherein the shape of said shaped top radome surface is substantially concave.

15. A method for ballistically shielding an antenna equipment unit from a projectile, comprising:

providing a shaped top radome surface adapted to substantially cover the antenna equipment unit, wherein the shaped top radome surface comprises a curved surface that provides for increased obliquity angles configured normal to an exterior surface of the shaped top radome and adapted to deflect the projectile, a curvature of the curved surface extending to outer edges of the shaped top radome surface;

coupling a spall liner to an inner surface of surface on the top radome surface, wherein the spall liner is disposed between the antenna equipment unit and the shaped top radome surface;

coupling a first matching sheet to an inner surface of the spall liner between the antenna equipment unit and the spall liner;

coupling a second matching sheet to an outer surface of the shaped top radome surface, wherein the first and second matching sheets provide an impedance match to a dielectric framework formed by the shaped top radome surface and the spall liner; and press fitting the outer edges of the shaped top radome surface, the spall liner and the first and second matching sheets between a sloped edge of a top plate, which has a curvature that is complementary to the curvature of the curved surface at the outer edge of the shaped top radome surface, and a base plate.

16. The method for ballistically shielding an antenna equipment unit according to claim 15 further comprising coupling the shaped top radome surface to a secondary surface with an attachment mechanism.

17. The method for ballistically shielding an w-antenna equipment unit according to claim 15, further comprising configuring the shape of the shaped top radome surface to comprise at least a portion of an arc.

18. The method for ballistically shielding an antenna equipment unit according to claim 15, further comprising configuring the shape of the shaped top radome surface to provide structural strength against center projectile impacts.

19. The method for ballistically shielding an antenna equipment unit according to claim 15, further comprising configuring the shape of the shaped top radome surface to increase at least one of:

a space between the inner surface of the spall liner and the top of the antenna equipment unit; and a space for locating the antenna equipment unit.

* * * * *